United States Patent [19]

Schiel

[11] 4,190,964

[45] Mar. 4, 1980

[54] WEB DRYING SECTION FOR PAPER MACHINE

[75] Inventor: Christian Schiel, Heidenheim, Fed. Rep. of Germany

[73] Assignee: J. M. Voith GmbH, Heidenheim, Fed. Rep. of Germany

[21] Appl. No.: 877,981

[22] Filed: Feb. 15, 1978

[30] Foreign Application Priority Data

Mar. 19, 1977 [DE] Fed. Rep. of Germany ..... 2712184
Aug. 12, 1977 [DE] Fed. Rep. of Germany ..... 2736334

[51] Int. Cl.[2] ..... F26B 13/08

[52] U.S. Cl. ..... 34/114; 34/23; 34/159

[58] Field of Search ..... 34/114, 122, 23, 155, 34/156, 159; 226/95; 162/181

[56] References Cited

U.S. PATENT DOCUMENTS

| | | | |
|---|---|---|---|
| 3,071,869 | 1/1963 | Latimer et al. | 34/114 |
| 3,387,384 | 6/1968 | Sutton | 34/114 |
| 3,576,078 | 4/1971 | Holt | 34/23 |
| 3,733,711 | 5/1973 | Haythornwaite | 34/23 |
| 3,738,108 | 6/1973 | Herzhoff et al. | 34/155 |

*Primary Examiner*—Edward G. Favors
*Attorney, Agent, or Firm*—Ostrolenk, Faber, Gerb & Soffen

[57] ABSTRACT

The web drying section of a paper machine has a plurality of drying cylinders; an air permeable belt passes around one cylinder and the web to be dried passes outside the belt around the one cylinder; gussets defined in the region of initial engagement and final disengagement of the feeder belt with the one cylinder; the entrance side gusset includes an air lock to eliminate the boundary layers of air on the feeder belt and the drying cylinder and to minimize return of ambient air into the entrance side gusset, thereby to hold the web to the belt and drying cylinder; the exit side gusset includes an air lock adapted to permit the boundary layers of air to leave the exit side gusset and also to minimize return of ambient air into the exit side gusset; features of the air locks are disclosed; additional suction means improve the vacuum in the air lock gussets.

16 Claims, 4 Drawing Figures

WEB DRYING SECTION FOR PAPER MACHINE

BACKGROUND OF THE INVENTION

The invention relates to a drying section for a web drying machine for drying paper webs, or the like. In particular, the invention concerns air lock means which securely hold the web being dried and the feeder belt for that web to the principal drying cylinder. The invention will hereafter be described with respect to a paper web. It should, however, be understood that the invention is adapted for drying other moistened webs.

The drying section for a paper machine includes a plurality of drying cylinders therein. A paper web runs over these drying cylinders. An air permeable, usually endless, feeder belt, is applied directly to the exterior peripheral jacket or surface of at least one of the drying cylinders. Usually, the feeder belt is comprised of a porous material, e.g. a felt-like fabric material. The web to be dried passes around the outside surface of the feeder belt while the inside surface of the belt is in contact with the drying cylinder.

With known drying sections for paper machines, the web of paper sometimes undesirably lifts off the feeder belt as the web and feeder belt are being wrapped and deflected around the drying cylinder. This occurs due to pneumatic overpressures which are produced at the entrance side gusset defined at and before the line of initial engagement between the feeder belt and the overlying paper web, on the one hand, and the drying cylinder on the other hand. This also occurs as a result of centrifugal forces that are operative during the entire movement of the web around the drying cylinder. The lifting of the web off the drying cylinder produces blisters and wrinkles in the eventually dried paper web. Furthermore, heat emanating from the drying cylinder does not sufficiently pass through the feeder belt to the paper web if direct contact between the web and the feeder belt and between the feeder belt and the drying cylinder are not maintained. The intermediate air layer which may develop under the web prevents complete drying.

At high operating speeds, the paper web is subjected to a high elastic strain due to the centrifugal forces applied to the web as it wraps and deflects around the drying cylinder. If the web is not adequately adhered to the feeder belt and the drying cylinder, this elastic strain on the web can be expressed according to the formula $R_o=v^2/g$, where $R_o$ designates that breaking length component which is required for compensating for the centrifugal force. At a machine speed of 25 m./sec., the minimal breaking length must amount to 64 mm., for example, to simply counteract the effects of centrifugal force. Moist paper webs being dried, however, only have a low wet strength. Therefore, it is important that a web be safely guided through the drying section in order to prevent blistering, wrinkling or perhaps even tearing of the web.

SUMMARY OF THE INVENTION

It is the primary object of the invention to prevent a web of paper, or the like, while it is deflecting around a drying cylinder, from forming blisters or wrinkles or even from being torn.

It is a further object of the invention to prevent the web from lifting off the feeder belt beneath.

It is still a further object of the invention to improve adhesion of the web being dried and also the feeder belt over which the web is passing as the feeder belt and web are deflecting around the drying cylinder.

It is another object of the invention to produce a partial vacuum in the vicinity of the line of initial contact between the feeder belt and the drying cylinder and in the vicinity of the line along which the feeder belt and the drying cylinder disengage.

It is yet another object of the invention to realize the foregoing objects by eliminating or reducing the boundary layers of air at the feeder belt and at the drying cylinder at least near the line along which the feeder belt and drying cylinder initially engage.

It is yet another object of the invention to increase the vacuum beneath the web in the vicinity of the initial contact between the drying cylinder and the feeder belt, thereby to enhance adhesion of the web and feeder belt to the drying cylinder.

It is a further object of the invention to realize those objects by increasing the vacuum beneath the web in the vicinity of the line along which the feeder belt and drying cylinder disengage.

According to the present invention, at least an entrance side gusset is formed on the entrance side of the drying cylinder, at which initial engagement between the feeder belt and the drying cylinder occurs. As the feeder belt moves in toward the surface of the drying cylinder, the cross-section and volume of the entrance side gusset space decreases. An exit side gusset may be formed at the exit or outlet side of the drying cylinder where the feeder belt separates from the drying cylinder. As the feeder belt moves away from the drying cylinder, the cross-section and volume of the exit side gusset space increases.

At each of the gussets, an air lock is established which extends substantially across the entire length of the main drying cylinder for at least reducing the amount of air that may enter the gusset and thereby generating a partial vacuum in the gusset, which causes the feeder belt, and especially the web wrapped about the feeder belt, to be drawn by suction securely against the surface of the drying cylinder and causes the web to be deflected around the drying cylinder while in secure engagement therewith.

With respect to the entrance side gusset, any air that might be present in the narrowing cross-section entrance side gusset space would undesirably be forced through the porous feeder belt and would thereby lift the paper web off the feeder belt. The partial vacuum in the entrance side gusset space eliminates that air pressure that might force the web off the feeder belt.

Correspondingly, in the exit side gusset space, a partial vacuum is also produced, ensuring that the paper web does not prematurely lift off the drying cylinder.

To maintain a partial vacuum in the entrance side gusset space, the entrance side gusset is closed off by an air lock located slightly away from and upstream of the line of initial contact between the feeder belt and the drying cylinder. Similarly, to maintain a partial vacuum in the exit side gusset space, the exit side gusset is closed off by an air lock located slightly removed from and downstream of the line of final contact between the feeder belt and the drying cylinder. The air locks extend substantially across the entire length of the main drying cylinder. Even at extremely high web speed, lift off of the paper web from the feeder belt can be safely avoided both at the entrance and the exit sides of the drying cylinder through partial evacuation of the entrance and exit side gusset spaces.

A partially evacuated gusset space at the entrance side produces a significant improvement in drying section operation, even at relatively low operating speeds. A partially evacuated gusset space at the exit side with its associated air lock, has been found necessary only at high web operating speeds.

As the web, feeder belt and drying cylinder move along, they drag air along with them, principally at the boundary layers immediately adjacent their respective surfaces. The higher the operating speeds, the greater the volume of the boundary layer of air that is dragged along by the feeder belt and by the peripheral surface of the drying cylinder. One significant technique according to the invention for at least partially evacuating the entrance side gusset is to extend the air lock at the entrance side gusset so as to block the boundary layers of air for the feeder belt and for the drying cylinder from entering the entrance side gusset.

Although the boundary layer of air adjacent to the feeder belt at the entrance side gusset should, as much as possible, be prevented from entering the entrance side gusset space, nonetheless, the air lock of the entrance side gusset can be spaced away from the feeder belt to a minor extent. This prevents the feeder belt from having any mechanical contact with the air lock means, thereby precluding the feeder belt from being worn by such contact.

Even though the air lock at the entrance side gusset does not contact the feeder belt, nonetheless the boundary layer of air at the feeder belt should be removed to the maximum possible extent before the feeder belt enters the entrance side gusset space. In the preferred version of the invention, the air lock at the entrance side gusset comprises bristles which extend across the gap from the body of the air lock toward the feeder belt, and these bristles completely or nearly completely bridge this gap. When the bristles are long enough to contact the feeder belt, which depends upon the length of the bristles and the placement of the air lock, the bristles are preferably comprised of material having good sliding properties, such as polytetrafluoroethylene, which is marketed under the trademark Teflon.

As a further feature of the invention, the air lock of the entrance side gusset may have openings for venting the entrance side gusset space so that any air that has been trapped inside the entrance side gusset space, together with any of the air from the boundary layers that has entered the entrance side gusset space, may escape therefrom.

At the exit side gusset, the air lock may also be spaced away from the feeder belt to a minor extent for preventing undesirable wear of the feeder belt. At the exit side gusset, it is desirable that the feeder belt carry away any air at its boundary layer, as this will enhance the vacuum in the exit side gusset. Thus, the body of the exit side air lock is spaced sufficiently from the feeder belt so that the air lock does not or only minimally interferes with the exit of the boundary layer of air at the feeder belt, thereby to ensure that the feeder belt carries away as much of this boundary layer of air as is practicable. In a practical embodiment, the gap between the air lock in the exit side gusset and the feeder belt is in the range of from 1–5 mm.

The air lock at the exit side gusset prevents any return flow of air into the evacuated exit side gusset space. In this manner, a quite effective vacuum is produced in the exit side gusset space, which holds the paper web securely to the feeder belt and to the drying cylinder.

For the same reason as the exit side air lock is spaced from the feeder belt, it should also be correspondingly spaced from the peripheral surface of the drying cylinder. If for practical design reasons and for support and placement of the air lock, the air lock does extend to the peripheral surface of the cylinder, then, according to the invention, the air lock should extend to the cylinder surface only over short length sections along the full length of the drying cylinder. With the above described construction of the air lock, the boundary layers of air at both the feeder belt and the drying cylinder are removed from these rapidly moving elements, and the air lock prevents other air from being sucked into the exit side gusset from the outside.

To help maintain the desired gaps between both of the air locks and the feeder belt and both air locks and the drying cylinder, the drying cylinder itself supports the air locks of both the exit and entrance side gussets in their respective positions with respect to the drying cylinder and the feeder belt. One way of accomplishing this is to have the air locks of both the entrance and exit side gussets contact the drying cylinder at various separated points along the length of the drying cylinder. As noted above, however, at the exit side gusset, this contact between the air lock and the drying cylinder is preferably only over short sections of the drying cylinder so that the air boundary layer at the surface of the drying cylinder is blocked as little as possible from leaving the exit side gusset space. According to a preferred embodiment, the body of the exit side air lock includes cutouts on the side thereof facing the periphery of the drying cylinder. These cutouts define air venting gaps between the air lock and the periphery of the cylinder. These venting gaps preferably having a height off the periphery of the cylinder in the range of from 1–5 mm. The boundary layer of air adhering to the periphery of the cylinder passes out of the exit side gusset through these venting gaps, thereby improving the vacuum in the exit side gusset space.

By contrast, at the entrance side gusset, uninterrupted contact of the air lock over the entire length of the drying cylinder is desirable for blocking entrance of the boundary layer of air at the surface of the drying cylinder into the entrance side gusset space.

Suction devices may be provided for exhausting air from both of the entrance and exit side gusset spaces inside their air locks. The respective suction devices may communicate into the gusset spaces through openings in the air locks. By use of the suction devices, the level of vacuum in both the entrance and the exit side gusset spaces can be closely controlled. The suction device may include a single suction channel having separate air conductors leading therefrom into the respective gusset spaces. Alternatively, the gusset spaces for the entrance and exit side gussets can be suctioned at various different levels of vacuum as particular webs and particular drying operations may require.

The entrance and exit side air locks are attached to a carrier or support, which extends over the full width of the drying machine and at the least over the full length of the drying cylinder. This rigidly supports the air locks and enables the air locks to be safely set in any desired positions without significant oscillations or deflections during use. Certain machines now in operation already have a fixedly positioned guide roller over which the feeder belt is frequently fed. This guide roller can be blocked against rotating in the present invention and then the guide roller can serve as the air lock carrier for fixedly supporting the air locks against motion.

For maximum uniformity across the width of the paper web and across the full length of the drying cylinder, the side ends of the gusset spaces at the ends of the drying cylinders are closed off by appropriate locking pieces, which help maintain uniform vacuum and pressure across the full length of the drying cylinder.

A particularly inexpensive, yet quite effective aspect of the invention is for the entrance side and/or exit side air locks to each be comprised of a single piece extending the full length of the drying cylinder.

DESCRIPTION OF THE PREFERRED EMBODIMENTS

Figures 1, 2, 3:
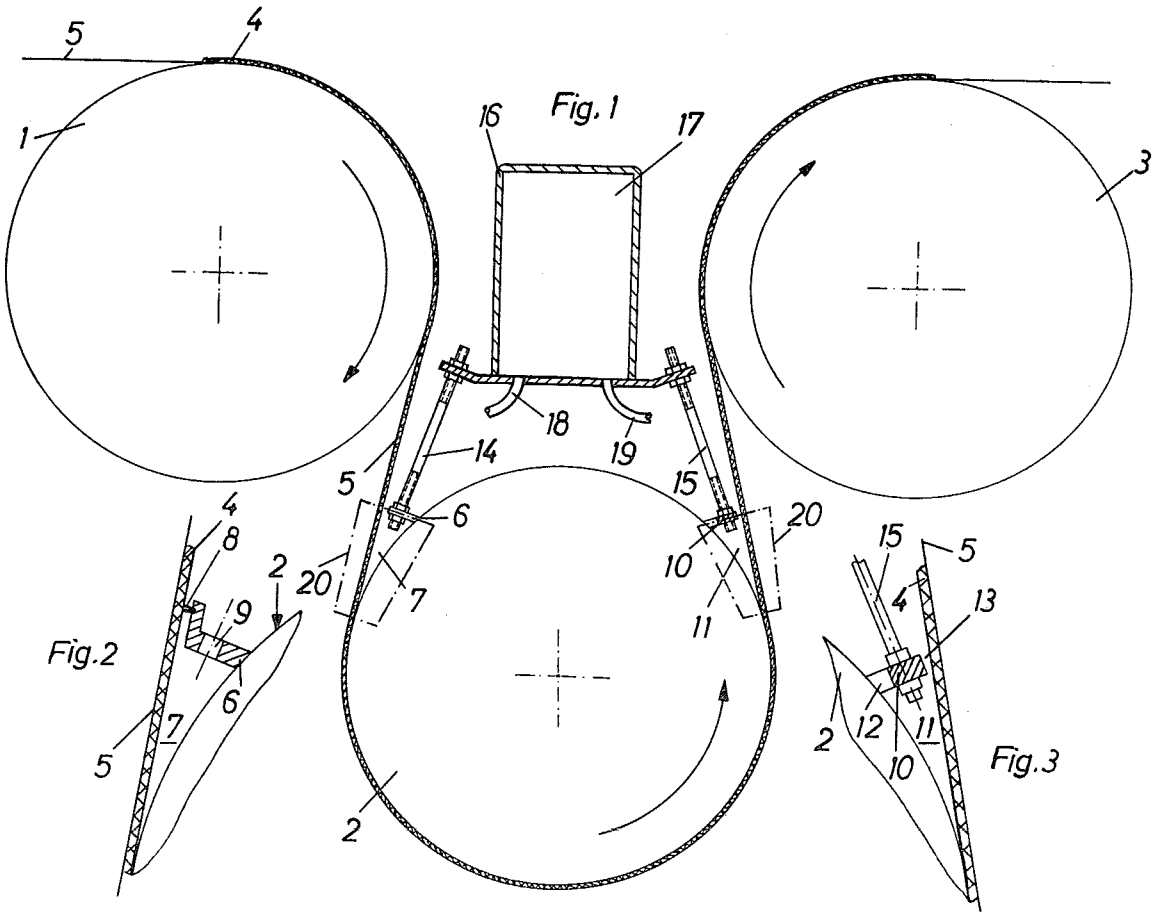
FIG. 1 is a schematic, cross-sectional, side elevational view of one drying section according to the invention.
FIG. 2 is an enlarged view of the entrance side gusset of the drying section of FIG. 1.
FIG. 3 is an enlarged view of the exit side gusset of the drying section of FIG. 1.

With reference to FIGS. 1–3, a first embodiment of drying section for a paper machine is illustrated. A typical paper machine in which such drying section would be incorporated is shown, for example, in U.S. Pat. No. 2,186,874.

The illustrated drying section includes three adjacent drying cylinders, 1, 2 and 3. Cylinder 2 is located both lower than and between cylinders 1 and 3 so that a web can be fed off cylinder 1 to cylinder 2 and off cylinder 2 to cylinder 3, with the web being able to wrap around a significant arcuate portion of the surface of the central drying cylinder 2 and also over significant arcuate portions of the drying cylinders 1 and 3. All three cylinders 1, 2 and 3 are conventionally supported stationary in position by means (not shown) for rotation about their respective rotation axes.

A preferably endless feeder belt 4 (shown broken or discontinuous in FIG. 1) is sequentially looped around the cylinders 1, 2 and 3 and then over a return or idler roller (not shown). The feeder belt is a flexible air permeable or porous element and may be comprised of a porous fabric or felt, or the like.

The paper web 5 to be treated passes first over the cylinder 1, then under the cylinder 2 and then over the cylinder 3. The paper web passes over the cylinders along the underside of the belt 4. Therefore, the web is directly in contact with the cylinders 1 and 3. However, the paper web passes at the underside of belt 4 and therefore outside belt 4 at cylinder 2. The web 5 is not in direct contact with the cylinder 2 on which the feeder belt 4 is directly applied.

With reference to FIGS. 1 and 2, an air lock means or selvedge 6 extends across the entire length of the drying cylinder 2 and is placed at a location spaced away from the line of initial contact between the feeder belt 4 and the peripheral surface of the drying cylinder 2 at the upstream side thereof. The air lock 6 defines a gusset space 7 at the entrance side gusset. The air lock 6 is in direct, substantially rubbing contact with the peripheral surface of the drying cylinder 2. As the drying cylinder 2 rotates counterclockwise in FIGS. 1 and 2, the air lock 6 strips off the boundary layer of air that is normally carried along with the rotating drying cylinder, thereby preventing this boundary layer of air from entering the entrance side gusset space 7.

The air lock 6 extends across the gap between the drying cylinder 2 and the feeder belt 4, but it does not extend completely to the feeder belt 4. Instead, a slight gap exists between the rigid body of the air lock 6 and the feeder belt 4 for preventing the air lock 6 from rubbingly engaging the feeder belt and prematurely wearing it. As noted hereinabove, it is desirable for the boundary layer of air at the side of the feeder belt facing into the gusset space 7 to also be stripped away. For this purpose, a bristle brush 8, extending the full length of the air lock, i.e. the full length of the drying cylinder, is attached to the body of the air lock 6 and extends into engagement with the feeder belt 4 for interfering with and stripping off the boundary layer of air that travels with the surface of the feeder belt. The bristles, as noted above, are comprised of a slippery material, e.g. a material marketed under the trademark Teflon, for reducing wear of the feeder belt.

Openings 9 formed in and spaced along the air lock 6 communicate between the gusset space 7 and the outside for venting any air that gets into or is trapped in the entrance side gusset space 7. The reduction or elimination of the boundary layers of air at the air lock 6 helps create the desirable vacuum in the gusset space 7. The vacuum is communicated through the porous feeder belt 4 and thereby suctions the paper web 5 securely into engagement with the feeder belt 4 and thereby into secure engagement with the drying cylinder 2.

Turning to FIGS. 1 and 3, an air lock 10 is also formed at the exit side, slightly downstream of the line along the drying cylinder where the feeder belt separates from the drying cylinder. The air lock 10 defines the exit side gusset space 11 inside this exit side gusset. The exit side air lock 10 extends substantially over the entire length of the drying cylinder 2. The exit side air lock also is applied to and supported against the periphery of the drying cylinder. The exit side air lock is adapted to prevent air from entering the exit side gusset space to replace the air removed therefrom at the boundary layers of air of the feeder belt and the drying cylinder. The air lock 10 should not interfere with the exit of these boundary layers of air from the exit side gusset space, in contrast with the air lock 6 at the entrance side which does interfere with the boundary layers of air.

The exit side air lock, although applied directly to the drying cylinder, is provided with a series of cutouts 12 along its length along drying cylinder which provide air gaps having a height off the drying cylinder preferably in the range of 1 mm. to 5 mm. According to the length along the drying cylinder and the height off the drying cylinder of these cutouts, the boundary layer of air carried by the peripheral surface of the cylinder can be more or less completely exhausted from inside the exit side suggest space 11.

The air lock 10 also does not extend completely to the feeder belt 4. Instead, an open space 13 is provided through which the boundary layer of air carried along by the feeder belt 4 can be moved out of the exit side gusset space 11. The air lock 10, placed where it is shown, prevents any return flow of ambient air into the gusset space 11.

In the way described above, a vacuum in the gusset space 11 is produced which helps secure the paper web to the feeder belt 4 over a relatively long range extending from the entrance side gusset all the way over to the exit side gusset.

As shown in FIG. 1, a rigid stationary carrier 16 extending over the full width of the drying machine and therefore over the full length of the drying cylinder 2 is illustrated. Struts 14 and 15 respectively support the air locks 6 and 10 in their illustrated positions by means of the struts being, in turn, supported by the carrier 16.

A suction device, which includes the channel 17 formed in the carrier 16, is connected through one or more suction lines 18 to the entrance side gusset space 7. Similarly, the channel 17 is connected through one or more suction lines 19 to the exit side gusset space 11. For appropriately regulating the levels of vacuum in the entrance side gusset space and in the exit side gusset space 11, appropriate adjustable flow dampers, or the like valving means, may be provided in the lines 18 and 19, in channel 17 or the suction devices may be damped in other ways that would be known to one skilled in the art.

The open ends of the gusset spaces 7 and 11 at the ends of the drying cylinder 2 are closed off by locking pieces 20 indicated in broken lines in FIG. 1. These locking pieces close off the gusset spaces to prevent ambient air from entering the gusset spaces from the side and they also help maintain the uniformity of suction on the paper web 5 across the entire width of the web and across the entire length of the drying cylinder 2.

Figure 4:
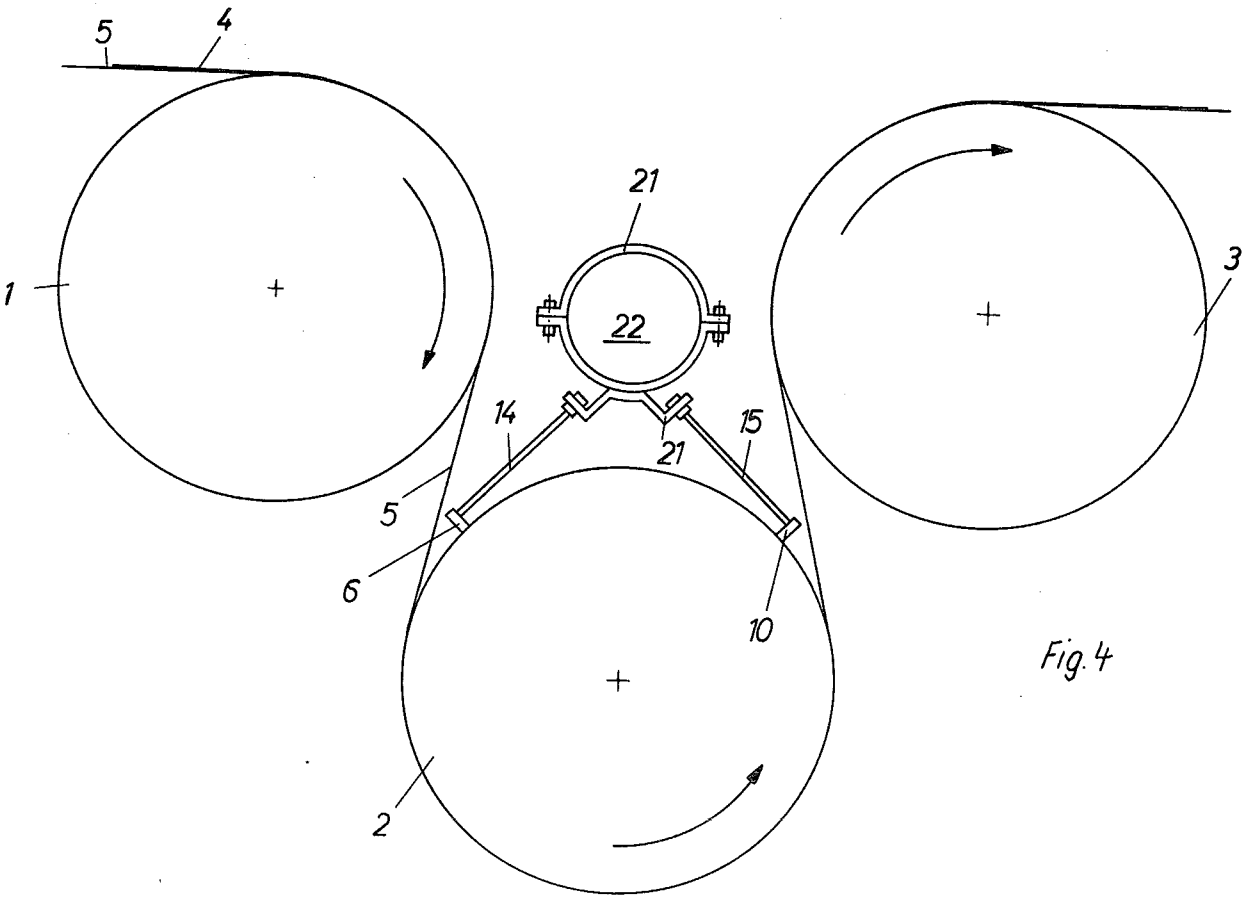
FIG. 4 is a schematic side elevational view, similar to FIG. 1, of a slightly modified embodiment of the invention.

Turning to FIG. 4, a slightly modified embodiment of the apparatus of FIGS. 1–3 is shown. In this embodiment, the same drying section is used. But, it has a standard feeder belt guiding roller 22 which is conventionally supported stationary in position in the drying section of the paper machine. The feeder belt guiding roller 22 is at its normal position between and at the same level as the drying cylinders 1 and 3. Typically, the feeder belt and the web carried thereon would have been looped around the guiding roller 22 after leaving the drying cylinder 2 and before being fed to the drying cylinder 3. But in this embodiment, the guiding roller 22 is not used for performing a guiding function. Instead, the feeder belt guiding roller 22 is used as an attachment support or carrier for the air locks 6 and 10. As in the first embodiment, the air locks are supported by respective struts 14 and 15. In this embodiment, however, the struts are themselves connected by the two part lug 21 or by mounting tabs that are welded or screwed in place and which are all in turn connected to the guiding roller 22. The guiding roller 22 is, in this case, supported on the machine frame against rotating with respect to the machine frame, whereby the guide roller is a stationary, fixed support for the air locks.

Other features of this second embodiment would be the same as in the first embodiment and are therefore not described in further detail.

Although the present invention has been described in connection with a plurality of preferred embodiments thereof, many variations and modifications will now become apparent to those skilled in the art. It is preferred, therefore, that the present invention be limited not by the specific disclosure herein, but only by the appended claims.

What is claimed is:

1. A drying section for a machine, said section for drying a web of paper, or the like; said drying section comprising:

a plurality of drying cylinders over which the web to be dried is run;

an air permeable feeder belt passing around said cylinders and being in engagement with the web being dried, wherein said belt is along one side surface of the web and said belt is on that said surface of the web for said belt to be between the web and one said drying cylinder;

with respect to the motion of the web over said one cylinder, said one cylinder having an entrance side at which said belt first contacts said one cylinder and having an exit side at which said belt disengages from said one cylinder;

at said entrance side of said one cylinder, an entrance side gusset being defined at and just before the line across said one cylinder of initial engagement between said belt and said one cylinder;

entrance side air lock means extending substantially across the entire length of said one cylinder and placed at the entrance side of said entrance side gusset spaced from the line of initial contact between said belt and said one cylinder for preventing air from penetrating into the entrance side gusset space which is defined inside said entrance side gusset and which is defined by said entrance side air lock means, said belt and said one cylinder;

said one cylinder and said feeder belt both inherently having respective air boundary layers over their surfaces which layers are carried along by them as they move and which layers would normally move with them into said entrance side gusset space; said entrance side air lock means being shaped to extend into and to block the air flow along at least one of the boundary layers entering said entrance side gusset space.

2. The drying section of claim 1, wherein said entrance side air lock means is spaced along said belt from and is located before the line of initial contact between said belt and said one cylinder.

3. The drying section of claim 2, wherein said entrance side air lock means comprises an entrance side air lock element that blocks air flow into said entrance side gusset space and said entrance side air lock element being spaced a small distance from said feeder belt, thereby defining a small gap between them.

4. The drying section of claim 3, wherein said entrance side air lock means further comprises bristles extending from said entrance side air lock element toward said feeder belt for substantially bridging said small gap between said entrance side air lock element and said feeder belt.

5. The drying section of claim 4, wherein said bristles are comprised of a material with food sliding properties.

6. A drying section for a machine, said section for drying a web of paper, or the like; said drying section comprising:

a plurality of drying cylinders over which the web to be dried is run;

an air permeable feeder belt passing around said cylinders and being in engagement with the web being dried, wherein said belt is along one side surface of the web and said belt is on that said surface of the web for said belt to be between the web and one said drying cylinder;

with respect to the motion of the web over said one cylinder, said one cylinder having an entrance side at which said belt first contacts said one cylinder and having an exit side at which said belt disengages from said one cylinder;

at said entrance side of said one cylinder, an entrance side gusset being defined at and just before the line across said one cylinder of initial engagement between said belt and said one cylinder;

entrance side air lock means extending substantially across the entire length of said one cylinder and placed at the entrance side of said entrance side gusset spaced from the line of initial contact between said belt and said one cylinder for preventing air from penetrating into the entrance side gusset space which is defined inside said entrance side gusset and which is defined by said entrance side air lock means, said belt and said one cylinder;

at said exit side of said one cylinder, an exit side gusset which is defined at and just after the line across said one cylinder of disengagement of said one belt and said one cylinder;

exit side air lock means extending substantially across the entire length of said one cylinder and placed at the exit side of said exit side gusset and spaced from the line of disengagement between said belt and said one cylinder for preventing air from penetrating into the exit side gusset space which is defined inside said exit side gusset and which is defined by said exit side air lock means, said belt and said one cylinder;

said exit side gusset and said exit side air lock means are held in position in the radial direction of said one cylinder at least in part by said one cylinder;

said exit side air lock means comprises an exit side air lock element; said exit side air lock element has cutouts defined therethrough from outside said exit side gusset space to inside said exit side gusset space; said cutouts being at the side of said exit side air lock elememt and extending toward said one cylinder for thereby defining an air gap between said one cylinder and said exit side air lock element, through which air gap the boundary layer of air at said one cylinder may pass.

7. The drying section of claim 6, wherein said cutouts are sized to define air gaps having a height, away from said one cylinder, in the range of 1–5 mm.

8. A drying section for a machine, said section for drying a web of paper, or the like; said drying section comprising:

a plurality of drying cylinders over which the web to be dried is run;

an air permeable feeder belt passing around said cylinders and being in engagement with the web being dried, wherein said belt is along one side surface of the web and said belt is on that said surface of the web for said belt to be between the web and one said drying cylinder;

with respect to the motion of the web over said one cylinder, said one cylinder having an entrance side at which said belt first contacts said one cylinder and having an exit side at which said belt disengages from said one cylinder;

at said entrance side of said one cylinder, an entrance side gusset being defined at and just before the line across said one cylinder of initial engagement between said belt and said one cylinder;

entrance side air lock means extending substantially across the entire length of said one cylinder and placed at the entrance side of said entrance side gusset spaced from the line of initial contact between said belt and said one cylinder for preventing air from penetrating into the entrance side gusset space which is defined inside said entrance side gusset and which is defined by said entrance side air lock means, said belt and said one cylinder;

at said exit side of said one cylinder, an exit side gusset which is defined at and just after the line across said one cylinder of disengagement of said one belt and said one cylinder;

exit side air lock means extending substantially across the entire length of said one cylinder and placed at the exit side of said exit side gusset and spaced from the line of disengagement between said belt and said one cylinder for preventing air from penetrating into the exit side gusset space which is defined inside said exit side gusset and which is defined by said exit side air lock means, said belt and said one cylinder;

a carrier separated from said cylinders, said entrance side air lock means and said exit side air lock means being attached to and supported by said carrier; said carrier extending across the length of said one cylinder.

9. The drying section of claim 8, further comprising a first suction device connected with said entrance side gusset space defined within said entrance side gusset and comprising a second suction device connected with said exit side gusset space defined within said exit side gusset, both for suctioning air from the respective said gusset spaces;

both said suction devices together comprising a channel extending along said carrier and each of said suction devices comprising a respective suction line connecting said channel and the respective one of said entrance side gusset space and said exit side gusset space.

10. The drying section of claim 8, wherein said carrier comprises a guiding roller extending in the same direction as and spaced from said cylinder; means blocking said guiding roller against rotating.

11. A drying section for a machine, said section for drying a web of paper, or the like; said drying section comprising:

a plurality of drying cylinders over which the web to be dried is run;

an air permeable feeder belt passing around said cylinders and being in engagement with the web being dried, wherein said belt is along one side surface of the web and said belt is on that said surface of the web for said belt to be between the web and one said drying cylinder;

with respect to the motion of the web over said one cylinder, said one cylinder having an entrance side at which said belt first contacts said one cylinder and having an exit side at which said belt disengages from said one cylinder;

at said entrance side of said one cylinder, an entrance side gusset being defined at and just before the line across said one cylinder of initial engagement between said belt and said one cylinder;

entrance side air lock means extending substantially across the entire length of said one cylinder and placed at the entrance side of said entrance side gusset spaced from the line of initial contact between said belt and said one cylinder for preventing air from penetrating into the entrance side gusset space which is defined inside said entrance side gusset and which is defined by said entrance side air lock means, said belt and said one cylinder;

at said exit side of said one cylinder, an exit side gusset which is defined at and just after the line across said one cylinder of disengagement of said one belt and said one cylinder;

exit side air lock means extending substantially across the entire length of said one cylinder and placed at the exit side of said exit side gusset and spaced from the line of disengagement between said belt and said one cylinder for preventing air from penetrating into the exit side gusset space which is defined inside said exit side gusset and which is defined by said exit side air lock means, said belt and said one cylinder;

locking pieces at the opposite ends of said entrance side gusset and at the opposite ends of said exit side gusset and said locking pieces also being placed generally at the ends of said one cylinder; said locking pieces being for sealing said entrance side gusset space and said exit side gusset space.

12. A drying section for a machine, said section for drying a web of paper, or the like; said drying section comprising:

a plurality of drying cylinders over which the web to be dried is run;

an air permeable feeder belt passing around said cylinders and being in engagement with the web being dried, wherein said belt is along one side surface of the web and said belt is on that said surface of the web for said belt to be between the web and one said drying cylinder; with respect to the motion of the web over said one cylinder; said one cylinder having an entrance side at which said belt first contacts said one cylinder and having an exit side at which said belt disengages from said one cylinder;

at said exit side of said one cylinder, an exit side gusset being defined at and just after the line across said one cylinder of disengagement between said belt and said one cylinder;

exit side air lock means extending substantially across the entire length of said one cylinder and placed at the exit side of said exit side gusset and being spaced along said belt from and being located after the line of disengagement between said belt and said one cylinder;

said exit side air lock means comprising an exit side air lock element that blocks air flow into said exit side gusset space and said exit side air lock element being spaced a distance from said feeder belt for defining a gap between them; said exit side air lock element being for preventing air from penetrating into the space exit side gusset which is defined by said exit side air lock means, said feeder belt and said one cylinder.

13. The drying section of claim 12, wherein said gap between said exit side air lock element is spaced from said feeder belt and is large enough that said exit side air lock element at most slightly affects the air boundary layer carried along over said feeder belt, as said feeder belt moves out of said exit side gusset said exit side air lock element.

14. The drying section of claim 13, wherein said gap between said exit side air lock means and said feeder belt being in the range of 1 to 5 mm.

15. A drying section for a machine, said section for drying a web of paper, or the like; said drying section comprising:

a plurality of drying cylinders over which the web to be dried is run;

an air permeable feeder belt passing around said cylinders and being in engagement with the web being dried, wherein said belt is along one side surface of the web and said belt is on that said surface of the web for said belt to be between the web and one said drying cylinder; with respect to the motion of the web over said one cylinder; said one cylinder having an entrance side at which said belt first contacts said one cylinder and having an exit side at which said belt disengages from said one cylinder;

at said exit side of said one cylinder, an exit side gusset being defined at and just after the line across said one cylinder of disengagement between said belt and said one cylinder;

exit side air lock means extending substantially across the entire length of said one cylinder and placed at the exit side of said exit side gusset and spaced from the line of disengagment between said belt and said one cylinder for preventing air from penetrating into the space exit side gusset which is defined by said exit side air lock means, said feeder belt and said one cylinder;

said exit side gusset and said exit side air lock means thereof are held in position in the radial direction of said one cylinder at least in part by said one cylinder;

said exit side air lock means comprises an exit side air lock element; said exit side air lock element has cutouts defined therethrough from outside said exit side gusset space to inside the exit side gusset space; said cutouts being at one side of the said exit side air lock element and extending towards said one cylinder for thereby defining an air gap between said one cylinder and said exit side air lock element, through which air gap the boundary layer of air at said one cylinder may pass.

16. A drying section for a machine, said section for drying a web of paper, or the like; said drying section comprising:

a plurality of drying cylinders over which the web to be dried is run;

an air permeable feeder belt passing around said cylinders and being in engagement with the web being dried, wherein said belt is along one side surface of the web and said belt is on that said surface of the web for said belt to be between the web and one said drying cylinder;

with respect to the motion of the web over said one cylinder, said one cylinder having an entrance side at which said belt first contacts said one cylinder and having an exit side at which said belt disengages from said one cylinder;

at said entrance side of said one cylinder, an entrance side gusset being defined at and just before the line across said one cylinder of initial engagement between said belt and said one cylinder;

entrance side air lock means extending substantially across the entire length of said one cylinder and placed at the entrance side of said entrance side gusset spaced from the line of initial contact between said belt and said one cylinder for preventing air from penetrating into the entrance side gusset space which is defined inside said entrance side gusset and which is defined by said entrance side air lock means, said belt and said one cylinder;

at said exit side of said one cylinder, an exit side gusset which is defined at and just after the line across said one cylinder of disengagement of said one belt and said one cylinder;

exit side air lock means extending substantially across the entire length of said one cylinder and placed at the exit side of said exit side gusset and being spaced along said belt from and being located after the line of disengagement between said belt and said one cylinder and comprising an exit side lock element for preventing air from penetrating into the exit side gusset space which is defined inside said exit side gusset and which is defined by said exit side air lock means, said belt and said one cylinder; said exit side air lock element being spaced a small distance from said feeder belt for defining a gap between them;

said gap between said exit side air lock element and said feeder belt is in the range of 1–5 mm, to be large enough that said exit side air lock element at most slightly affects the air boundary layer carried along over said feeder belt, as said feeder belt moves out of said exit side gusset past said exit and side air lock element.

* * * * *